US005154431A

United States Patent [19]

Hayashi et al.

[11] Patent Number: 5,154,431

[45] Date of Patent: Oct. 13, 1992

[54] SPINNING BALL GAME ARTICLES

[75] Inventors: Naoharu Hayashi; Naomi Minami; Harumi Minami, all of Sakae, Japan

[73] Assignee: Sphip Co., Ltd., Osaka, Japan

[21] Appl. No.: 722,838

[22] Filed: Jun. 28, 1991

Related U.S. Application Data

[63] Continuation-in-part of Ser. No. 675,411, Mar. 25, 1991, abandoned.

[30] Foreign Application Priority Data

Apr. 11, 1990 [JP] Japan ..... 2-95782

[51] Int. Cl.[5] ..... A63B 43/00; A63B 59/00; A63B 67/00; A63B 67/14

[52] U.S. Cl. ..... 273/411; 273/58 K; 273/67 R; 273/128 CS; 273/341; 273/342

[58] Field of Search ..... 273/411, 58 R, 58 K, 273/67 R, 67 D, 67 DA, 67 DB, 67 DC, 128 CS, 342, 32 R, 32 H, 35 B, 176 L, 341, 88, 90, 87 R, 87 C, 184, 185, 352; 36/72 R

[56] References Cited

U.S. PATENT DOCUMENTS

| | | | |
|---|---|---|---|
| 278,341 | 5/1883 | Kelly | 273/411 X |
| D. 293,008 | 12/1987 | Muller | 273/411 X |
| 443,427 | 12/1890 | Brown | 273/411 X |
| 1,291,464 | 1/1919 | Folliard | 273/67 R |
| 1,772,804 | 8/1930 | Gillis | 273/128 CS |
| 2,309,475 | 1/1943 | Palmieri | 273/58 K X |
| 2,462,436 | 2/1949 | Stewart | 273/128 CS |
| 3,073,598 | 1/1963 | Tiikkainen | 273/67 R X |
| 3,231,278 | 1/1966 | Boulanger | 273/411 X |
| 3,383,708 | 5/1968 | Pappas | 2/22 |
| 4,149,723 | 4/1979 | Simon | 273/67 R X |
| 4,326,299 | 4/1982 | Bednar | 2/22 |
| 4,328,966 | 5/1982 | Miyamoto | 273/67 R X |
| 4,353,550 | 10/1982 | Krosnick | 273/67 R |
| 4,453,720 | 6/1984 | King | 273/411 |

FOREIGN PATENT DOCUMENTS

| | | | |
|---|---|---|---|
| 275368 | 10/1969 | Austria | 273/411 |

*Primary Examiner*—William H. Grieb

*Attorney, Agent, or Firm*—Trexler, Bushnell, Giangiorgi & Blackstone, Ltd.

[57] ABSTRACT

A ball, a racket and courts used in a new game or sport. The central idea behind this game is that a ball with a rotary shaft is whipped with a racket into a spinning motion. The ball comprises a spherical body having at least one shaft as a rotary shaft. The diameter of the spherical body is about 100–300 mm. The racket has a palm portion and a grip portion. The palm portion is made of a flexible material. The thickness of the palm portion is about 30–70 mm. A pair of ankle guards used to protect the ankles of players during play and specially designed courts for this game are also disclosed.

9 Claims, 10 Drawing Sheets

SPINNING BALL GAME ARTICLES

CROSS-REFERENCE TO RELATED APPLICATION

This is a continuation-in-part application of U.S. patent application Ser. No. 07/675,411 filed Mar. 5, 1991, now abandoned.

BACKGROUND OF THE INVENTION

The present invention relates to novel spinning ball game or sport articles, parts and courts for use in this game.

Numerous games or sports using balls are known such as soccer, rugby, basketball, volleyball, tennis, table tennis, etc. Such conventional ball games or sports have the following drawbacks.

In conventional ball games or sports, it is customary to use a single ball in play, so there is only one player who has control of the ball at any one time. The other players either wait for the ball to come their way or chase after the ball. If a team consists of good players, all have, on the average, frequent control of the ball. However, the individual athletic ability of students in primary school or junior high school, for example, may vary so much that unskillful students will have difficulty taking control of the ball. Since such students are likely to lose interest in playing the game, this is not desirable in the educational environment.

Conventional ball games or sports usually have a limited playing zone in which the players are allowed to play, and if a ball goes out of this limited playing zone, the game is temporarily interrupted. Such an interruption sometimes discourage the players and is thus not desirable.

In general, conventional ball games or sports have only one set of rules, and many reasons, such as an insufficient number of players, may prevent a game from being played. As a result, while there may be complaints about shortages of playing courts or fields, there remain unused playing courts or fields which can not be easily converted for other games or sports.

The present invention is intended to solve all or at least some of the aforementioned drawbacks of conventional ball games or sports.

SUMMARY OF THE INVENTION

The present invention may be understood from various aspects.

The first aspect of the present invention is a ball comprising a spherical body and two collinear shafts which protrude oppositely from the spherical body. It is preferable that ends of the two collinear shafts differ from each other in shape. The diameter of the spherical body is preferably about 100–300 mm.

The second aspect of the present invention is a racket which comprises a ball-contacting palm portion and an attached grip portion, the palm portion being made of a flexible material enclosed in a strong fabric. The thickness of the palm portion is preferably 30–70 mm.

The third aspect of the present invention is the combination of the ball and racket. The central idea behind the whole game or sport in the present invention is that the ball with shaft is hit or whipped with the racket into a spinning motion.

The fourth aspect of the present invention is a pair of ankle guards used to protect the ankles of players. The ankle guard in this invention is made of a flexible material and has a fastening strap.

The fifth aspect of the present invention is courts for use in this game.

One court in the present invention is a twelve-sided court comprising 12 straight lines extending radially from a center point to respective apexes at intersections of the twelve sides to form 12 isosceles triangles, and multiple 12-sided loop lines parallel with the twelve sides and spaced out from the center point. A preferable arrangement is the provision of a detachable fence on any of the 12-sided loop lines.

Another court in the present invention is a round table court comprising a round table body, a height adjustable supports secured underneath the table body, an inclined portion and a flat portion on the upper side of the table body and a rim provided at the outermost edge of the table body.

Still another court in the present invention comprises a flat portion and a fence surrounding the flat portion, said flat portion having a plurality of lateral lines at regular intervals and a plurality of circules with increasing diameter and with the centers of the circles shifted from one another so that the circles are not concentric.

As long as one has a ball and racket, anyone can enjoy spinning the ball wherever a hard, flat surface is available. Although dedicated courts have been devised in the present invention for official use, informal games can also be enjoyed without such courts, for example, on roads, on tennis courts or on ice.

Since these game articles are relatively simple in construction, they may be provided inexpensively as compared with other sporting goods.

The games in the present invention allow each player to have at least one set of ball and racket. Thus it is not necessary to wait for a ball to come or to run after it, which is usually the case in other sports. The games are not boring for the players because they are required to swing the racket consecutively lest the ball should tumble down.

The dedicated courts used in the present invention are provided with a fence. The fence prevents a ball in play from going out of the court and causes the ball to simply rebound from it. This means that the game has no interruptions which may discourage the players.

BRIEF DESCRIPTION OF THE DRAWINGS

The examples of the present invention will now be described with reference to the accompanied drawings, in which.

DETAILED DESCRIPTION OF PREFERRED EMBODIMENTS

Figure 1:
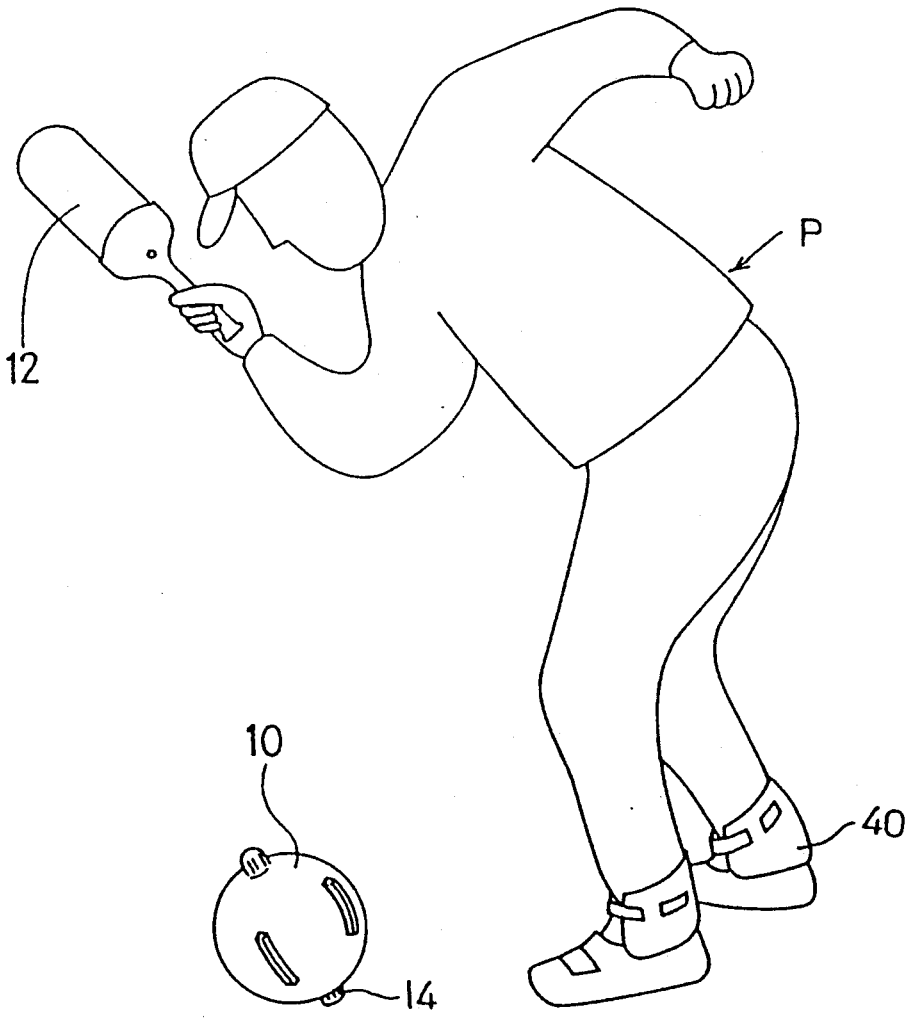
FIG. 1 is a perspective view showing a player in action.

FIG. 1 is a perspective view showing a player in action. As is evident from the drawing, the present invention relates to a game in which a ball 10 with shaft is spun by a player P by means of a whipping motion using a racket 12. The ball 10 not only rotates on a shaft 14 as its rotary shaft, but may also advance in a straight line or along an orbital path.

Figure 2:
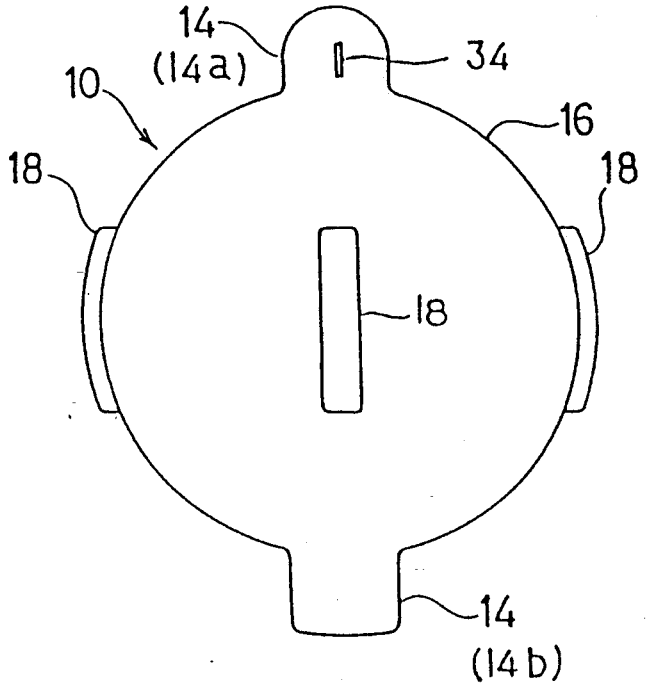
FIG. 2 is a front view of the ball in the present invention.
Figure 3:
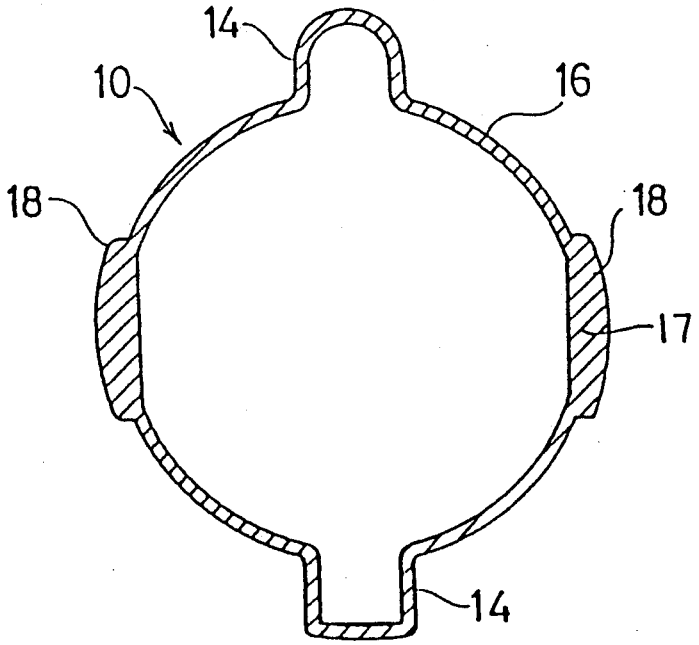
FIG. 3 is a cross sectional view of the ball.

FIG. 2 is a front view of the ball 10, and FIG. 3 is a cross sectional view of the same. The spherical body 16 and shaft 14 are preferably hollow structures made of a rigid plastic or synthetic rubber for strength and economy. However, other materials such as stainless steel or flexible foamed plastic may also be used for the ball and shaft. In case a flexible plastic foamed material is used, the inside may be solid.

As for methods of producing such balls, blow molding or injection molding is generally employed for processing rigid plastics or synthetic rubbers, and a stainless steel sheet, if used, may be processed by way of argon molding or pressing. The shaft member may be separately molded, and then attached to the spherical body. The spherical body may be made of plastic, and only the shaft member, which will be subject to severe wear, may be made of metal. Alternatively, the shaft member may be covered with a metallic cap.

When hollow-structured, the ball material is preferably thicker at the center portion 17 (corresponding to the area around the equator of the earth, when the ball is compared to the earth) in order to ensure stable rotation.

Experiments have shown that the diameter of the spherical body 16 is preferably about 100–300 mm, and more preferably 150–200 mm, and most preferably about 180 mm.

The spherical body 16 has low projections 18 provided longitudinally on the surface thereof in several places (4 in this embodiment). The dimension of each projection is about 5–10 mm in height, about 30–100 mm in length, and about 5–20 mm in width. These projections 18 are intended to facilitate the rotation of the ball when it is whipped with the racket 12 and to increase the rebound action when a ball crashes against another during play.

The shaft 14 is provided so as to jut out from at least one location on the spherical body 16. Actually, as illustrated, it is preferable to have two collinear shafts **14*a* and 14*b* which protrude from the upper and lower parts of the spherical body. In this case, it is preferable that each shaft end have a different roundness. The spherical body can rotate on either shaft, but the shaft 14*a*, which is more round, allows the ball to revolve in a small orbit, and the shaft 14*b***, which is less round in a large orbit. This is strategically important in the games which will be described later.

Figure 2A:
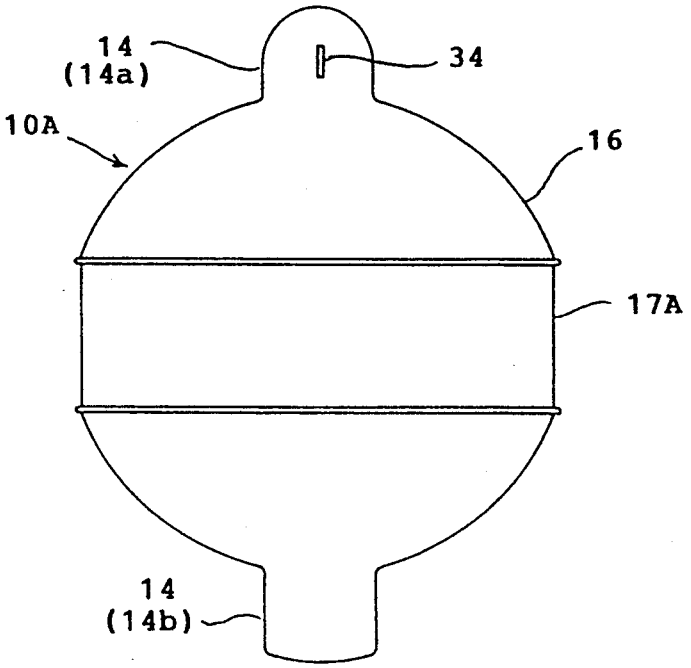
FIG. 2A is a front view of a modified ball in the present invention.
Figure 3A:
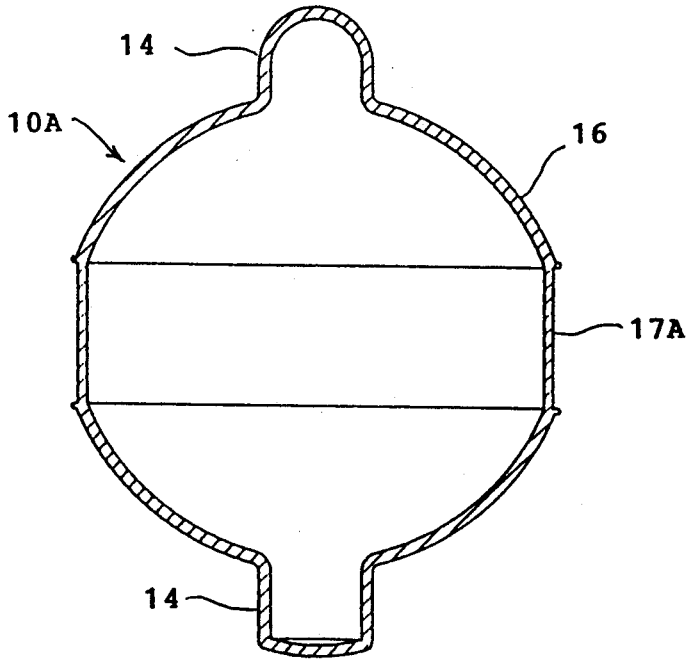
FIG. 3A is a cross sectional view of the ball of 2A.

FIG. 2A is a front view of a modified ball 10A in the present invention, and FIG. 3A is a cross sectional view of the same. Since this ball 10A is generally similar to the ball 10 in the first embodiment (in FIGS. 2 and 3), the same numbers are used to denote the same parts and the description thereof is omitted. This ball 10A differs from the ball 10 in the first embodiment in that it has no low longitudinal projections on the surface and that the center portion 17A (which was compared to the area around the equator in the first embodiment) is not spherical but cylindrical. The surface of the cylindrical center portion 17A is usually covered with a colored vinyl tape, which is used to distinguish one ball from another in the games to be described later.

Figure 4:
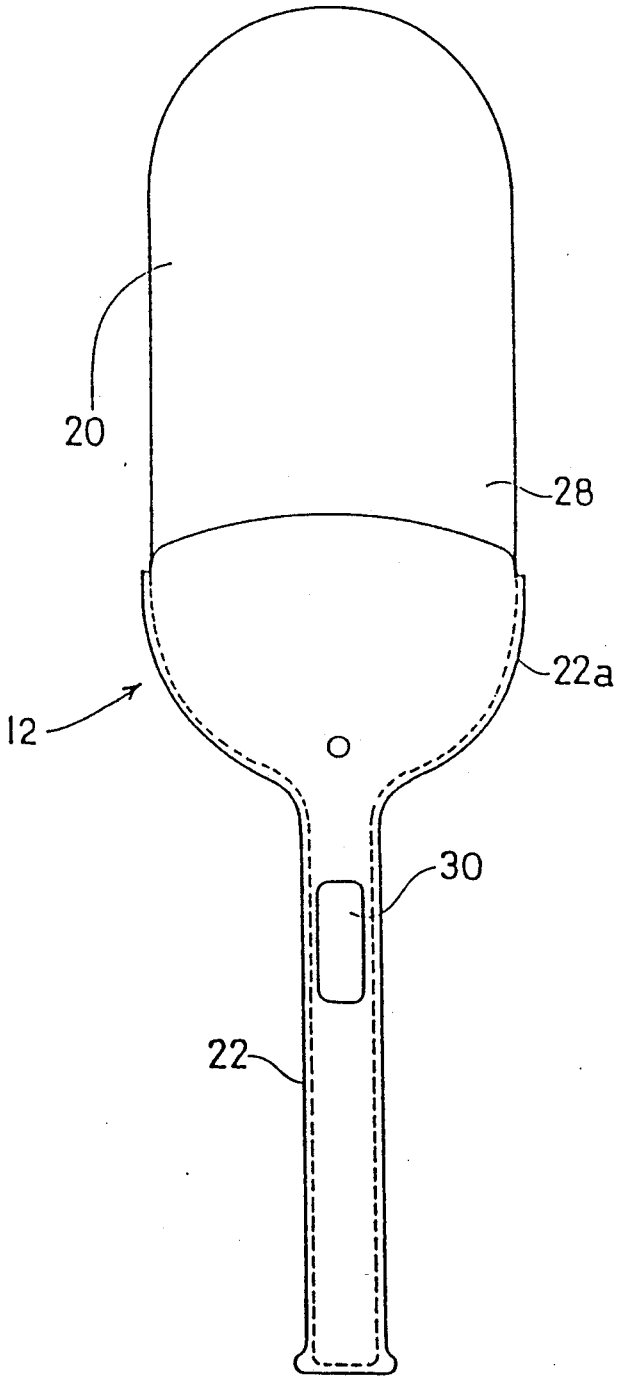
FIG. 4 is a front view of the racket in the present invention.
Figure 5:
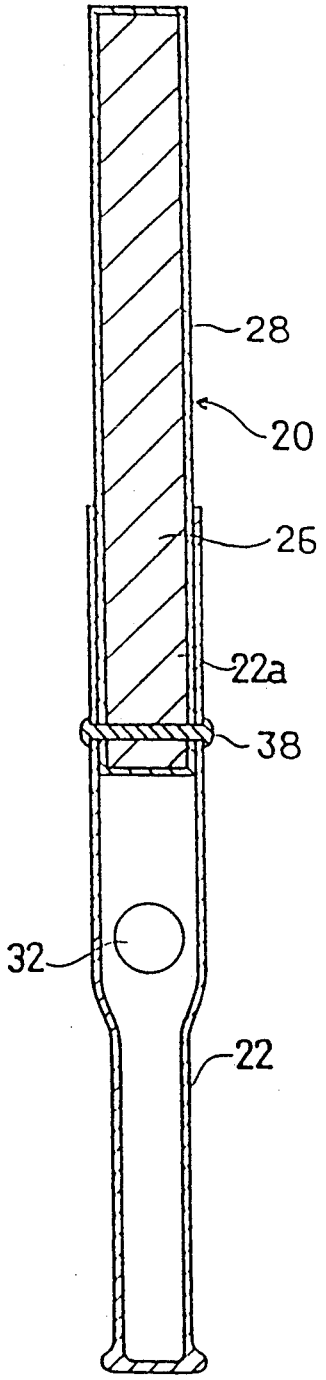
FIG. 5 is a cross sectional view of the racket.

FIG. 4 is a front view of the racket 12, and FIG. 5 is a cross sectional view of the same. The racket 12 is larger than a paddle for table tennis, and smaller than a tennis racket. The racket 12 is assembled from a palm portion 20 intended to whip the ball and a grip portion 22. The racket 12 is basically different from conventional rackets (e.g. table tennis paddle) in that the entire palm portion 20 is composed of a thickened flexible material.

The palm portion 20 comprises a flexible material 26 (e.g. sponge, foamed styrol) and a strong fabric 28 (e.g. canvas, leather) enclosing the flexible material 26. The palm portion is preferably of an oval shape. It has a thickness of, for example, about 30–70 mm.

The grip portion 22 may be a plastic-made unit. Though not essential in the present invention, the grip portion 22 may be provided with a rectangular opening 30 on the upper and lower sides and a round hole 32 on the left and right sides thereof. These holes permit a player to impart an initial spin to the a ball using a belt. In this provision, while the ball is stably supported with its top shaft end held in the round hole 32, the ball is spun by jerking through the rectangular opening 30 the belt wound around the top end of the ball shaft. The top end of the ball shaft may be provided with a small slot 34 (see FIG. 2) so that the end of the belt can easily be wound around the top end of the ball shaft.

The ball may also be spun by hand while the top end of the ball shaft is held in the round hole 32. In this case, it is unnecessary to use the belt.

The palm portion 20 and the grip portion 22 are combined, as shown in FIG. 4, by forcing one end of the palm portion 20 into a fan-shaped top end of the grip portion 22 and firmly securing the two elements by way of fastening means 38 (e.g. bolts and nuts, screws, nails, etc.) used at one or several locations on the grip portion.

When the game is being played with the ball 10 and the racket 12, the ball 10 sometimes hits the player P on the ankle. If hit hard, the ankle aches considerably and so each player should wear a pair of ankle guards 40 on the ankles (see FIG. 1).

Figure 6:
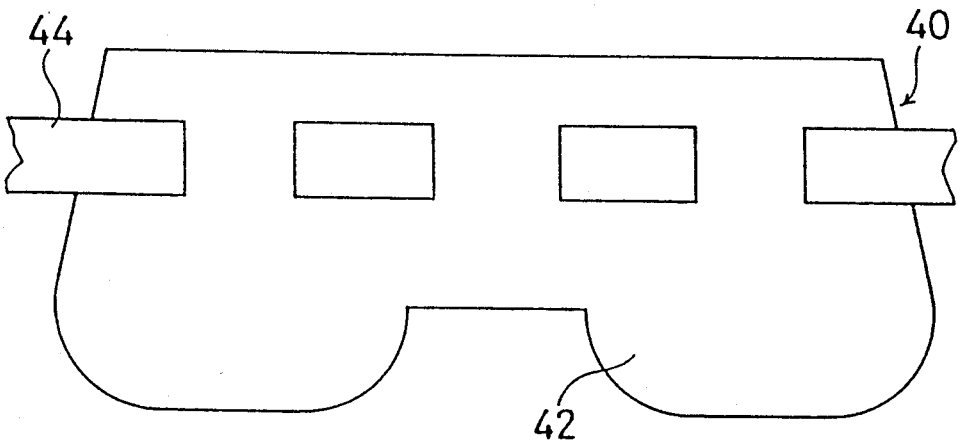
FIG. 6 is a front view of an ankle guard in the present invention.

The ankle guard 40 comprises, as shown in FIG. 6, a thick flexible material 42 and a strap 44 to fasten it on the ankle. The flexible material 42 is made of sponge or foamed styrol, for example. The shape and size of the flexible material need to be large enough to cover the ankle of a player. The strap 44 may be elastic like a rubber band, or inelastic with its ends attached by a fastener.

Various sports or games can be played using these game articles. So far, the inventors have devised over 20 different kinds of games. Only four representative games will be introduced hereinafter.

(1) "Circle Game"

Figure 7:
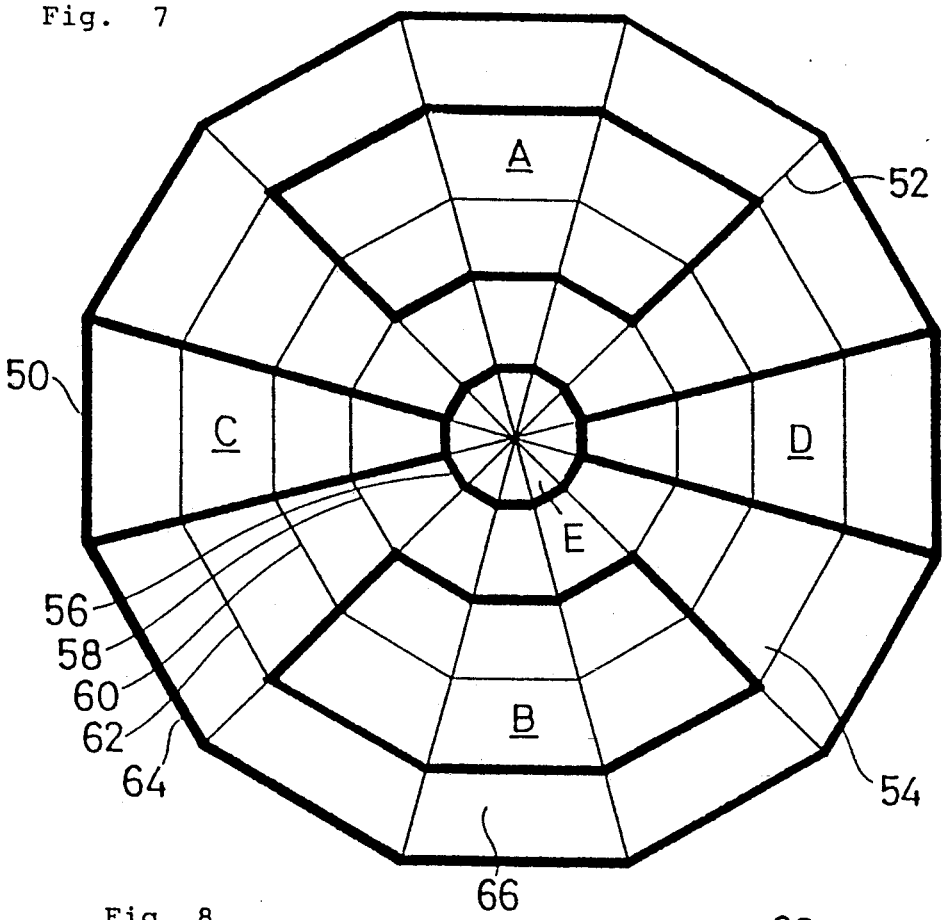
FIG. 7 is a plan view of the 12-sided court for use in the game in the present invention.

This game uses a specially developed novel court. FIG. 7 shows a 12-sided court 50 for use in this game. There are 12-straight lines 52 which extend radially from the center point to the apexes to form 12 isosceles triangles 54. A diagonal line is about 9 m long. The first loop line 56 of the 12-sided court is formed at a distance of about 75 cm from the center, and similarly, second, third, fourth, and fifth loop lines 58, 60, 62, and 64 are formed respectively at distances of 100 cm, 75 cm, 100 cm, 100 cm from the center. The intersections of the diagonal lines and loop lines form 48 trapezoids. Illustrated zones A, B are called "Whipping Stroke Zone", C, D, "Border Zone", and E "Center Zone".

An outdoor court may be constructed from a rigid plastic material for semi-permanent facilities. Other materials such as tiles or marbles may be used. For indoor courts, wooden flooring is an optimum material, or a thick plastic sheet, which is detachable and rollable, may be used. Since it is a considerably large-sized court, it may be produced in two or four segments which can be assembled on the spot.

Figure 8:
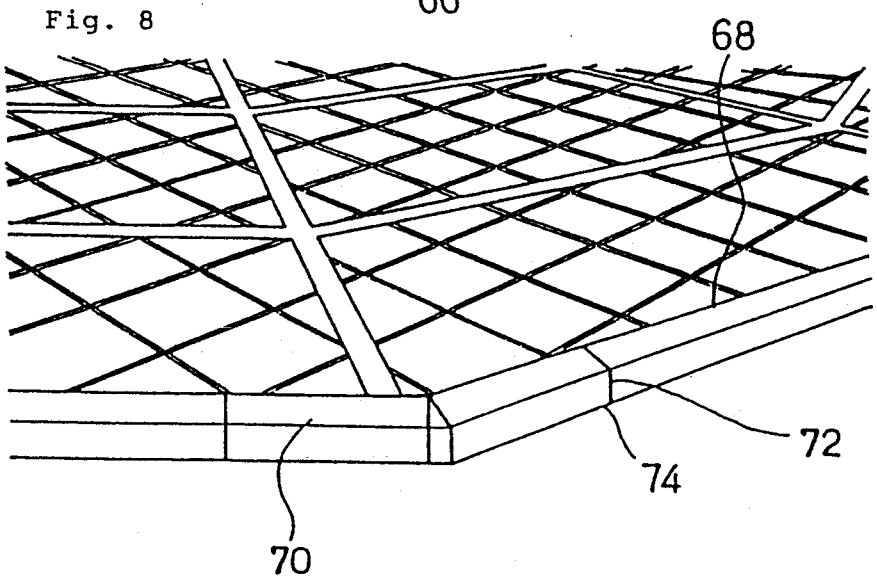
FIG. 8 is a perspective view of the fence and its angle bracket.

A fence 68 is provided on either the fourth or fifth loop line 62, 64. The fence 68 is generally placed on the fifth loop line 64, but when a speedy game is preferred, it is placed on the fourth loop line 62. The fence 68 may be placed inside the third loop line 60, but such a position will make the court too small, which is not desirable. The fence 68 consists of beams having a height of about 10–20 cm, which are simply placed on a loop line. The material used may be wood, metal, or plastic. To prevent the movement of the fence 68, angle brackets 70 are attached onto the portions corresponding to the individual apexes. The angle bracket 70 is a corner attachment with groove having an angle of 150 degrees, as shown in FIG. 8. The beam-like fence 68 fits into the groove portion 72. For a semi-permanent installation, both members 68 and 70 may be fastened by a fastening means 74 (e.g. bolts and nuts, nails, screws). The angle brackets 70 are preferably made of metal.

In the Circle Game, two players each carrying the ball 10 and the racket 12 enter his or her court with the Border Zone positioned therebetween. Each player whips a ball to give it an appropriate spin in the Stroke Zone, and serves the ball to the opponent's court. If the served ball is not received by the opponent, goes directly into the Whipping Stroke Zone of the opponent, or returns to his or her court through the opponent's court, he or she can score a point. If a player fails to receive the ball and the ball tumbles down in his or her court, then the opponent scores. Since the ball simply rebounds if it hits the fence, the game is not interrupted. One playing technique consists of a player hitting the ball against the fence on purpose so as to take advantage of the ball's rebound.

One variation of the Circle Game includes two goal nets, similar to the soccer goal, installed on two opposing sides of the 12-sided court. By hitting a ball into the opponent goal net, the player scores.

(2) "Lap Game"

Figure 9:
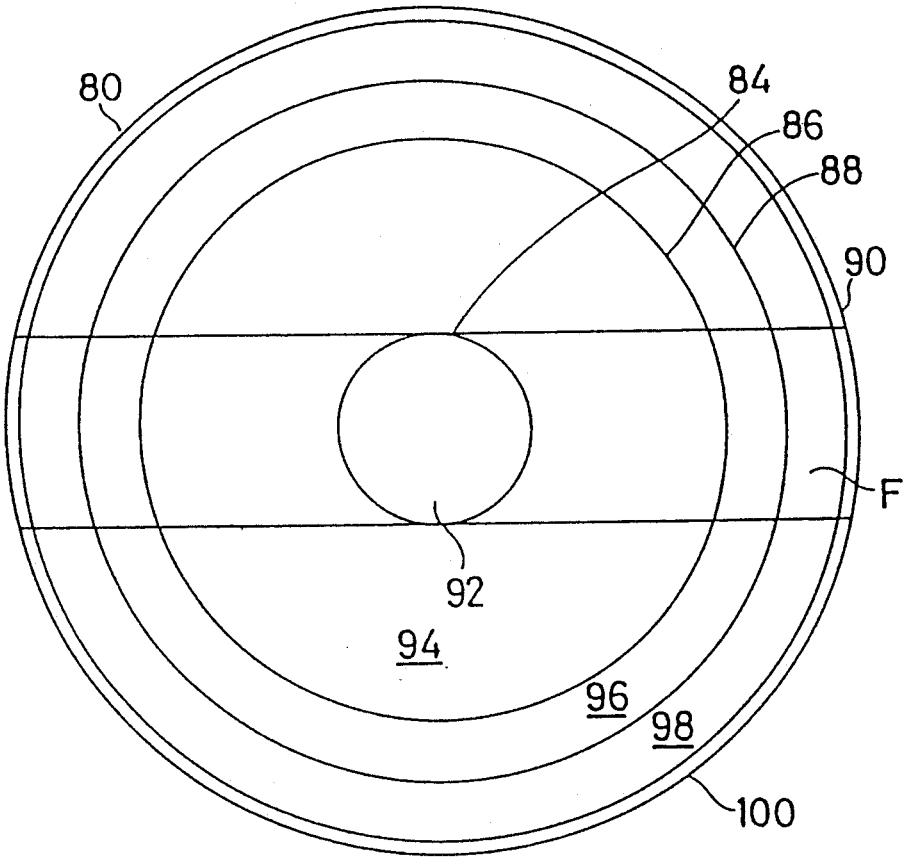
FIGS. 9 and 10 are plan and cross sectional views of the round table court for use in the game in the present invention.
Figure 10:
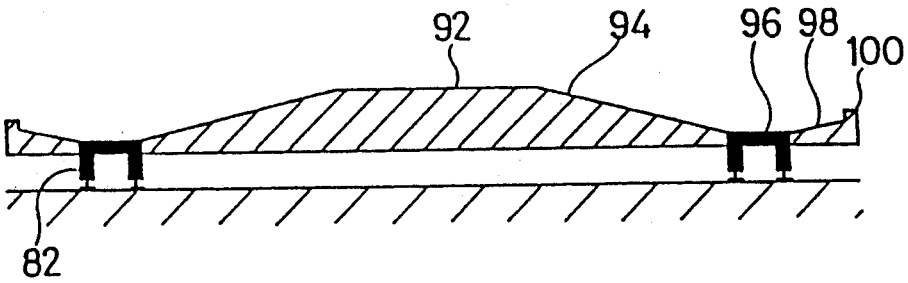

This game also uses a specially developed novel court. FIGS. 9 and 10 show the round table court 80 for use in this game. The diameter of the round table is about 3.5 m, and the court has a height adjustable support mounted underneath. The top surface of the table is not flat, having a inclined portion and a flat portion as shown in FIG. 10. FIG. 9, a top view, shows the table with its four concentric rings, 84, 86, 88, 90 which are arranged from the center at intervals of 80 cm, 25 cm, 25 cm, and 5 cm respectively. A flat central highland 92 is provided within the first ring 84. An inwardly inclined portion 94 is formed between the first ring 84 and the second ring 86. A flat valley 96 is located between the second ring 86 and the third ring 88. An outwardly inclined portion 98 is formed between the third ring 88 and the fourth ring 90. A fence 100 is formed of at the outermost edge. In FIG. 9, section F is a border zone which runs transversely through the center portion.

In another embodiment, though not illustrated, the entire central highland 92 is hollowed out to form a donut-shaped table.

The table court may be made of, for example, rigid plastic, wood or metal. Since the table court is a considerably large structure, it may be produced in two to sixteen segments and subsequently assembled.

Two players each having a ball and racket in hand are positioned opposite to each other with the border zone located between the players. Each player spins a ball by whipping and serves it into the opponent's court. At this time, the ball must not pass over the central highland 92. If the served ball is not received by the opponent, but simply returns to the player through the opponent's court, he or she can score a point. If the two balls collide in the opponent's court, he or she can score a point. Furthermore, if either or both balls bounce outside the opponent's court after the collision, or if either or both balls tumble down in the opponent's court, the player makes a high score.

As a game strategy, two balls may be spun in his or her court and are served in succession into the opponent's court. However, if two balls are served, there is a high possibility that the two balls will collide and one or both of them will tumble down in his or her own court, causing the opponent to score points.

(3) "Wanderer Game"

This game makes use of the 12-sided court used in the "Circle Game" and a rolling game article named "wandering disk".

Figure 11:
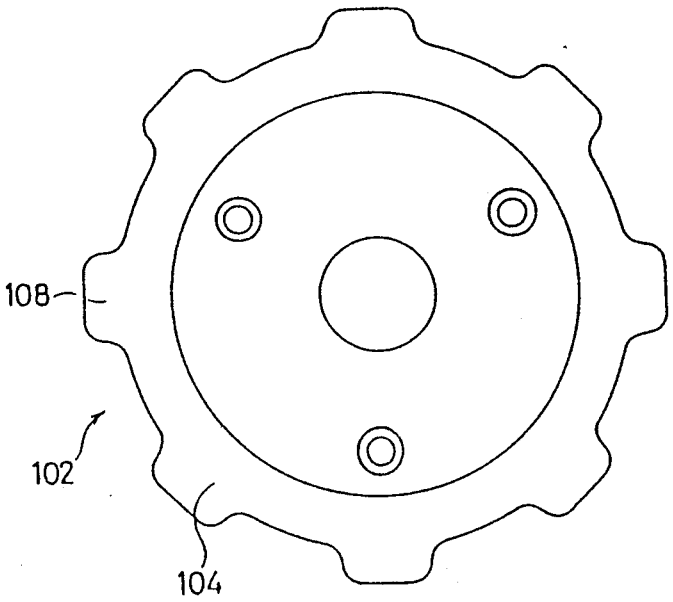
FIG. 11 is a plan view of a rolling game article, FIG. 12 a side view of the same, and FIG. 13 a cross sectional view of the same.
Figure 12:
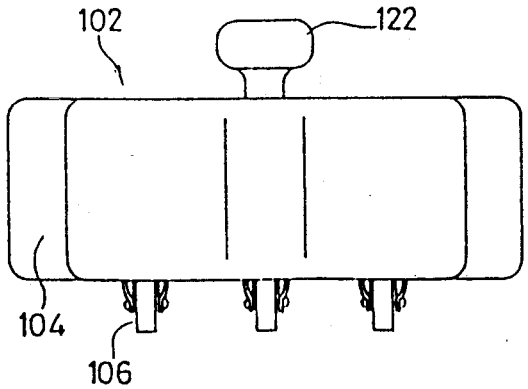
Figure 13:
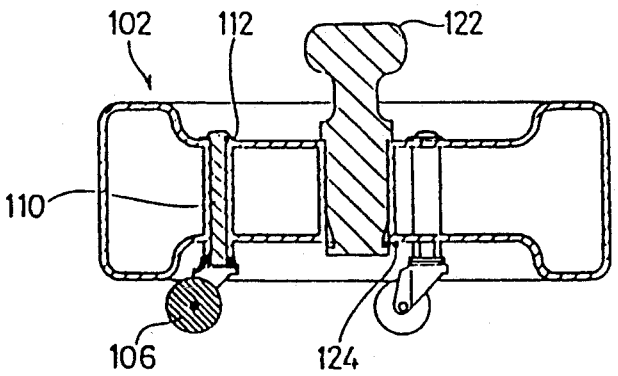

FIG. 11 is a plan view of the wandering disk, FIG. 12 is a side view and FIG. 13 is a cross sectional view of the same.

It is apparent from these views that the wandering disk 102 comprises a low, nearly cylindrical body 104 and casters 106 mounted underneath the body. Three or more casters may be used, but three are enough in general.

In a plan view (see FIG. 11), the wandering disk 102 looks like a gear since the body 104 has an uneven surface 108. The diameter of the body 104 is about 30 cm at the largest portion. The body 104 is molded out of a rigid plastic or synthetic rubber, and as shown in FIG. 13, it is preferably hollow for lightness. Alternatively, flexible plastic foam may be used to form a solid body. The molding process generally employs blow molding or injection molding.

The casters 106 mounted under the body can revolve 360 degrees. A mounting shaft 110 extends through the body longitudinally so that they are secured to the body on top by means of fasteners 112.

Figure 14:
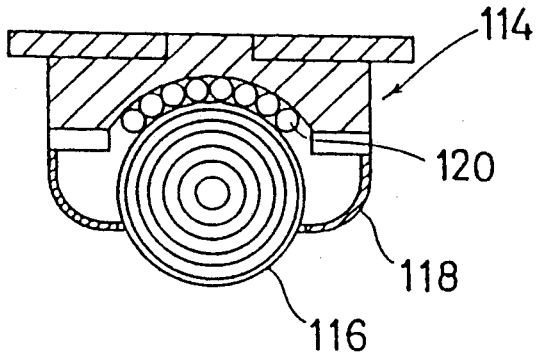
FIG. 14 is a cross sectional view of another embodiment of a caster used with the rolling game article.
Figure 15:
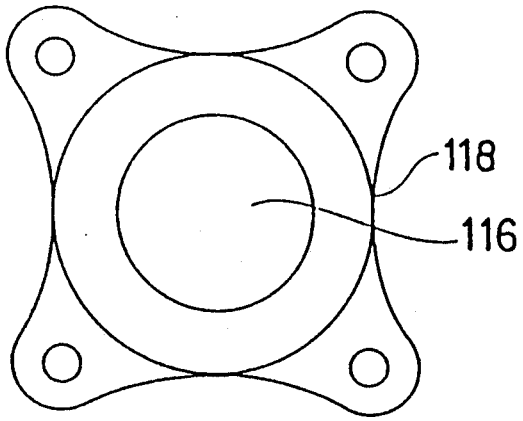
FIG. 15 is a front view of the same.

The caster may be replaced with a ball caster 114 as shown in FIGS. 14 and 15. A ball 116 can rotate against a bearing 120 within a housing 118. The ball 116 may be made of plastic or stainless steel. The use of such ball casters 114 facilitates a linear movement of the wandering disk, thus being suitable for beginners.

The body 104 has a handle 122 mounted on the central upper portion. The handle 122 extends longitudinally through the body 104 and secured under the body by means of a fastener 124. The top of the handle 122 is shaped like a flattened sphere for easy grasping.

The player carries the wandering disk 102 by hand, and delivers to a desired position by rolling it on the ground. However, as the casters 106, 114 are rotatable 360 degrees, in most cases, the wandering disk 102 does not move straight, but deviates from the course and fails to reach the desired position. This makes it very difficult to predict the movement of the wandering disk. Various games can be played using this particular property.

"Wanderer Game" is played in the aforementioned 12-sided court. Each of the two players whips a ball into motion in his or her own court and sends it at a wandering disk placed in the center in order to drive it into the opponent's court. The outcome of a game depends upon the position at which the wandering disk comes to a halt. Since it is very difficult to predict the direction of the wandering disk's movement because of its casters, this makes the game interesting.

Many games other than the above-described ones are prepared for the 12-side court and the table court in the present invention, and so these courts, once purchased, can be used for various games.

(4) "Looper Game"

Figure 16:
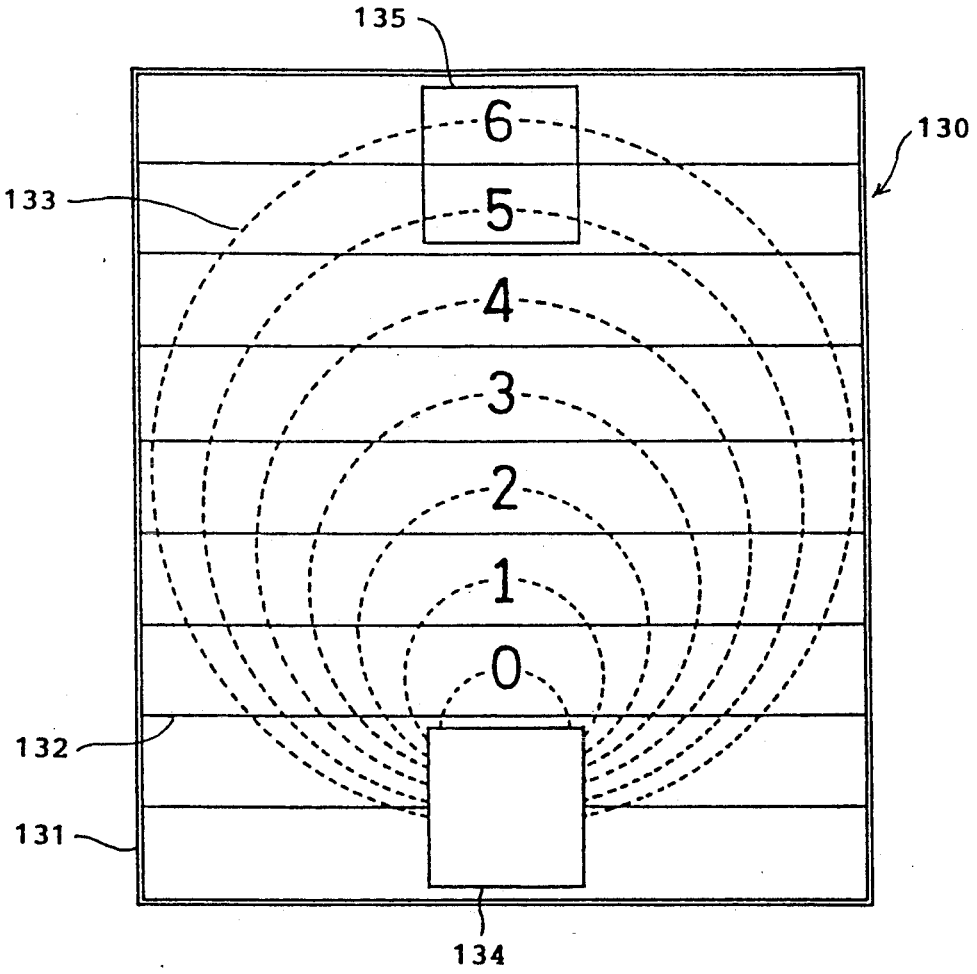
FIG. 16 is a plan view of a square court for use in the present invention.

This game is suitable for beginners. It uses a specially developed novel square court 130 as shown in FIG. 16. The square court 130 is about 9 m long and about 8 m wide and surrounded by a fence 131 of about 12 cm high at its periphery. The external shape of the court may be changed to a circular one by setting up a circular fence.

Inside the fence 131 are drawn 8 lateral straight lines 132 at regular intervals, which produce 9 rectangular sections. The lowest two sections in FIG. 16 comprise an area called the "Free Zone" and the remaining 7 sections comprise an area called the "Ball Travel Zone" or "Point Zone". The Ball Travel Zone consists of 7 rectangular sections numbered from 0 to 6.

There are also drawn two squares 134, 135 at the lower middle and upper middle portions. The lower middle square 134 is called the "Stroke Zone".

The court also has 7 dotted circles 133. The centers of the circles 133 are shifted from one another so that the 7 circles are not concentric, but pass a single common point in the Stroke Zone 134. Each circle passes through a corresponding rectangular section in the Ball Travel Zone.

An outdoor court may be constructed from a rigid plastic material for semi-permanent facilities. Other materials such as tiles or marbles may be used. For indoor courts, wooden flooring is an optimum material, or a thick plastic sheet, which is detachable and rollable, may be used. Since it is a considerably large-sized court, it may be produced in two or four segments which can be assembled on the spot.

In the Looper Game, a player enters the court 130 holding a ball and racket of the present invention. The player whips the ball to give it an appropriate spin, and performs a whipping stroke to send the ball from the Stroke Zone 134 so that it follows a circular path like a boomerang within the court 130 and returns to the Stroke Zone 134. It is relatively easy to send the ball along the small circles numbered 0, 1, 2 but difficult along the large circles numbered 4, 5, 6. The numbers in the rectangular sections or on the circles are therefore used to calculate the points scored by the player. If the ball tumbles down or if the ball hits the fence, the player does not score.

While preferred embodiments of the invention have been illustrated and described, other variations may be made utilizing the inventive concepts herein disclosed. It is intended that all such variations be considered as within the scope of the invention as defined in the following claims.

What is claimed is:

1. A set of spinning ball game articles comprising:

a ball comprising a spherical body, and two collinear shafts which protrude oppositely from the spherical body, each of which shafts defines a rotary central shaft about which the ball rotates when in rotation, and a racket comprising a grip portion and a flexible, elongate ball-contacting palm portion coupled with and extending longitudinally outwardly from said grip portion for striking said ball with a whip-like action, the palm portion being made of a flexible material enclosed in a strong fabric and the grip portion being relatively rigid.

2. A set of spinning ball game articles as set forth in claim 1, wherein the ends of the two collinear shafts of the ball differ from each other in shape.

3. A set of spinning ball game articles as set forth in claim 1, wherein the spherical body of the ball has a diameter of from 100 mm to 300 mm.

4. A set of spinning ball game articles as set forth in claim 1, wherein the palm portion of the racket has a thickness of from 30 mm to 70 mm.

5. A set of spinning ball game articles as set forth in claim 1, and further comprising:

an ankle guard comprising a flexible protective member and a fastening strap for covering the ankle of the player.

6. A set of spinning ball game articles as set forth in claim 1 and further comprising:

a court comprising a flat portion and a raised fence surrounding the flat portion, the flat portion having multiple parallel lateral lines extending thereacross and spaced at regular intervals and multiple progressively respectively circumscribed circles with respective increasing diameters and having centers shifted relative to one another so that the circles are not concentric.

7. A set of spinning ball games articles as set forth in claim 1 and further comprising:

a round table court, comprising a round table body having an upper surface and an underneath surface, a height adjustable support secured at said underneath surface of the table body, and an inclined portion and a flat portion provided at the upper surface of the table body and a raised rim provided at the outermost edge of the upper surface.

8. A set of spinning ball game articles as set forth in claim 1 and further comprising:

a 12-sided court, comprising twelve outer sides forming a closed plane figure and twelve straight lines which extend radially from a center point to respective apexes at intersections of the twelve sides to form twelve isosceles triangles, and a plurality of loop lines forming multiple 12-sided closed plane figures have respective sides parallel with respective ones of the twelve outer sides.

9. A set of spinning ball game articles as set forth in claim 8 and further comprising:

a rolling game article comprising a nearly cylindrical body having a top surface and an underneath surface, a handle jutting out from the top surface of the body, and at least 3 casters jutting out from the underneath surface of the body, each of the casters being rotatable through 360 degrees.

* * * * *